US006132830A

United States Patent [19]

O'Halloran

[11] Patent Number: 6,132,830

[45] **Date of Patent: *Oct. 17, 2000**

[54] SELF-CONTAINED, DISPOSABLE SMELL TEST KIT

[76] Inventor: Gerard O'Halloran, 3151 Dean Ct., #704, Minneapolis, Minn. 55416

[ * ] Notice: This patent issued on a continued prosecution application filed under 37 CFR 1.53(d), and is subject to the twenty year patent term provisions of 35 U.S.C. 154(a)(2).

[21] Appl. No.: 09/004,752

[22] Filed: Jan. 8, 1998

[51] Int. Cl.[7] ..... A61L 9/04

[52] U.S. Cl. ..... 428/40.1; 428/40.2; 428/43; 428/320.2; 428/321.2; 428/321.5; 428/905

[58] Field of Search ..... 428/40.2, 40.1, 428/43, 320.2, 321.2, 321.5, 905; 424/45; 514/730

[56] References Cited

U.S. PATENT DOCUMENTS

| | | | |
|---|---|---|---|
| 3,882,713 | 5/1975 | Nishida | 73/23 |
| 4,606,956 | 8/1986 | Charbonneau et al. | 428/40 |
| 4,661,388 | 4/1987 | Charbonneau | 428/43 |
| 4,696,766 | 9/1987 | Naipawer | 512/8 |
| 4,889,755 | 12/1989 | Charbonneau | 428/42 |
| 4,988,557 | 1/1991 | Charbonneau | 428/204 |
| 5,051,305 | 9/1991 | Whitaker | 428/402.2 |
| 5,233,988 | 8/1993 | Raghuprasad | 128/630 |
| 5,380,765 | 1/1995 | Hirsch | 514/731 |
| 5,445,821 | 8/1995 | Brown | 424/401 |
| 5,492,934 | 2/1996 | Hirsch | 514/370 |
| 5,591,146 | 1/1997 | Hasse | 604/359 |
| 5,904,916 | 5/1999 | Hirsch | 424/45 |

OTHER PUBLICATIONS

Author: David Sumner; Title: On Testing the Sense of Smell; Journal: Lancet, vol. 2; Date: 1962; pp: 895–897.

Author: Doron Lancet; Title: Molecular Mechanisms of Smell; pp: 1–2; off Microsoft Internet Explorer; Internet Address: http://www.weizmann.ac.il/brain/lancet/lancet.htm.

Author: Doron Lancet, et al.; Title: Olfactory Receptors: Biochemistry, Molecular Biology, Computer Modeling, Psychophysics and Human Genome Analysis; pp: 1–3; off Microsoft Internet Explorer; Internet Address: http://bioinfo.weizmann.ac.il/__1s/doron__lancet/doron__lancet.html.

Author: Michael Berry; Title: The Physiology of Taste; pp: 1–6; off Microsoft Internet Explorer; Internet Address: http://www.sff.net/people/mberry/taste.htm.

Title: UCI in the News; pp. 1–2; Date: Aug. 15–21, 1995; off Microsoft Internet Explorer; Internet Address: http://www.uci.edu/~inform/media/950822.html.

Title: Chemistry 257 Experiment 4B: Olfaction Tutorial; pp: 1–2; off Microsoft Internet Explorer.

Title: Compounds used in Smell Kits; pp: 1–3; off Microsoft Internet Explorer.

*Primary Examiner*—Nasser Ahmad

*Attorney, Agent, or Firm*—Kinney & Lange, P.A.

[57] ABSTRACT

A smell test kit for measuring the sense of smell of a test subject. The smell test kit comprising of a set of cards, a set of fragrance strips, adhesive and a plurality of rupturable microcapsules. The plurality of rupturable microcapsules are contained within the adhesive which secures at least a portion of the fragrance strips to the cards. When the adhesive is overcome and the fragrance strips are removed from the cards, the rupturable microcapsules burst and emit a distinct scent for each of the cards.

28 Claims, 2 Drawing Sheets

SELF-CONTAINED, DISPOSABLE SMELL TEST KIT

BACKGROUND OF THE INVENTION

The invention pertains to evaluating the sense of smell of a test subject. More particularly, it pertains to a self-contained, disposable smell test kit.

Assessing a patient's sense of smell has many important medical applications. These include aiding in diagnosing various medical conditions, such as the potential early detection of Alzheimer's and Parkinson's disease. Additionally, by evaluating the sense of smell both before and after nose or sinus surgery, the evaluation aids in assessing the success of the surgical procedure as well as in the detection of malingering patients. Evaluating the sense of smell also aids in the investigation of medical causes that result in a decrease or loss of the sense of smell.

There are various causes of loss or damage to the sense of smell. Viral infections and head trauma lead the causes resulting in a damaged sense of smell. Viral infections can kill off olfactory cells which generally grow back. However, the virus may kill a disproportionate number of olfactory cells or affect the patient's ability to regenerate olfactory cells and thus damage the sense of smell. The sense of smell can also be damaged by head trauma which can sever the delicate connections between the olfactory neurons. Other causes of damage or loss to the sense of smell can result from exposure to toxic chemicals. Exposure to benzene, chloride, mercury and various insecticides have been implicated as causes to a loss of the sense of smell. It is also believed that the early stages of Alzheimer's and Parkinson's disease may damage the sense of smell.

On rare occasions, nose or sinus surgery may also cause damage or loss of the sense of smell in a patient. However, malpractice claims against surgeons who perform these operations are becoming more prevalent. Without the ability to uniformly test the patient's sense of smell before and after the procedure, the surgeon's ability to defend against this type of malpractice claim is limited. Administering a uniform smell test before and after the surgical procedure would enable the surgeon to more accurately assess the surgical procedures affect on the patient's sense of smell and identify malingering patients.

Currently, there are two primary means to test the sense of smell. The first of these techniques is by use of vials of fluid which emit a distinct scent. However, this technique is difficult to use because each distinct scent requires its own vial. Thus several vials containing different scents have to be used just to create one test kit. Unless a hospital or medical office maintains multiple test kits, comprising multiple sets of vials of distinct scents, only one smell test can be performed at a time. Additionally, the test kit must be kept in a central location for access and use by multiple personnel. This raises logistical and accountability issues to ensure the vials are available when needed. The vial technique is also nondisposable, and therefore less sanitary which results in the potential transmission of infectious diseases between different patients. The scent which is transmitted by the fluid within the vials also loses strength over time. The vial testing method therefore does not provide a uniform testing technique which limits the effectiveness of comparing successive smell test results over time.

The second technique uses "scratch and sniff" pieces of paper. However, "scratch and sniff" technology does not release a potent aroma and the scents that are used are generally not easily recognizable which generates inaccurate results. Furthermore, the amount of scent that is released is dependant upon the number of scent bubbles that are scratched. The "scratch and sniff" smell test is therefore not administered uniformly, which further limits the effectiveness of the results over time. The vial and "scratch and sniff" techniques are also time intensive. There is therefore no known device to administer a uniform smell test that is easy to use, self-contained and disposable.

SUMMARY OF THE INVENTION

The invention is a device and a method for evaluating the sense of smell of a test subject. The devise comprises a set of cards, a set of fragrance strips, adhesive means and a plurality of rupturable microcapsules. The plurality of rupturable microcapsules are contained within the adhesive means which detachably secures at least a portion of the fragrance strips to the series of cards. Within the rupturable microcapsules is a distinct scent for each of the cards that is emitted when the microcapsules burst as a result of the adhesive means being overcome as the fragrance strip is detached from the card.

DETAILED DESCRIPTION OF THE PREFERRED EMBODIMENTS

Figure 1A:
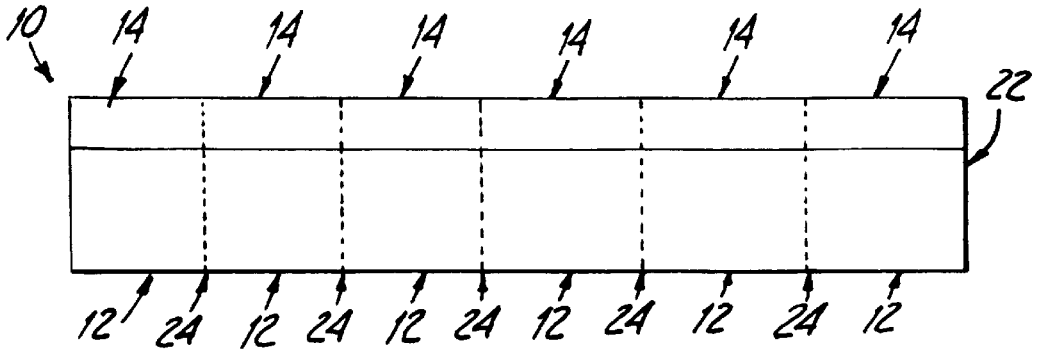
FIGS. 1A and 1B are a front and back views of a preferred embodiment of a self-contained disposable smell test kit.
Figure 1B:
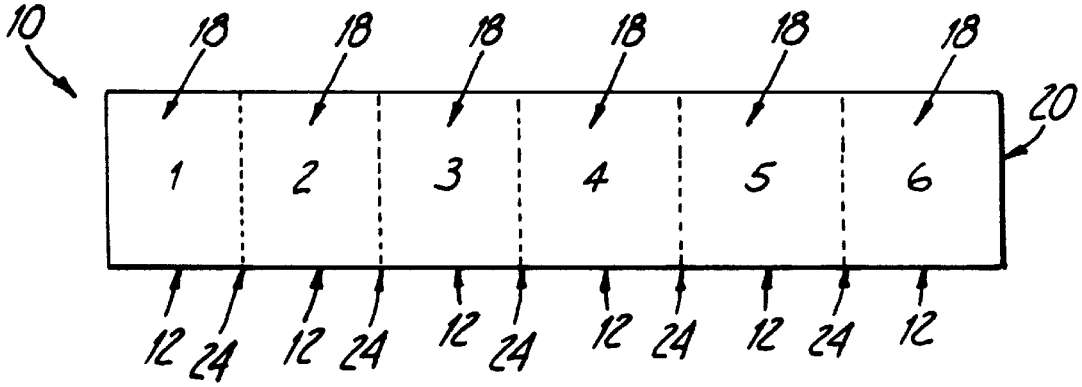

A preferred embodiment of a self-contained, disposable smell test kit 10 is shown in FIGS. 1A and 1B. The smell test kit 10 is comprised of a set of cards 12 upon which a set of fragrance strips 14 are adhered by adhesive means 16. In a preferred embodiment, the cards 12 have a uniform or similar appearance to each other, except for a distinctive mark 18 which is preferably located on a back 20 of the cards 12. The fragrance strips 14 are preferably adhered to a front 22 of the cards 12.

In a preferred embodiment, the cards 12 and the fragrance strips 14 are made of paper. The set of cards 12 are preferably secured to each other to maintain the integrity of the test kit 10 until it is used. However, the cards 12 are preferably separated from one another prior to being presented as part of the test to avoid mixing or presenting multiple distinct scents at one time during administration of the test. The cards 12 are preferably separated along a perforation line 24.

Figure 2A:
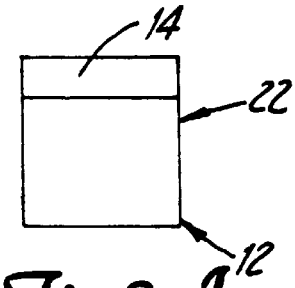
FIGS. 2A and 2B are a front and back views of a preferred embodiment of a uniform card of the invention prior to use.
Figure 2B:
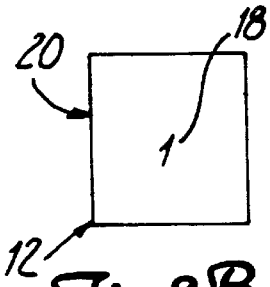

As shown in FIGS. 2A and 2B, each test card 12 can be separated from the others when administering the test. The test is administered by peeling or tearing away the fragrance strip 14 from the card 12. The fragrance strip 14 is adhered to the card 12 by adhesive means 16 through a technique which is well known in the art. The fragrance strip 14 can either be a completely separate piece of paper, or a portion of the card 12 which is folded back on itself. The distinctive mark 18, in conjunction with a key, preferably identifies what the distinct scent associated with each of the cards 12 are. By use of the key, the examiner can record the results of the evaluation. The distinctive marks 18 associated with the distinct scents for different smell test kits 10 can either remain the same or be varied.

Figure 3:
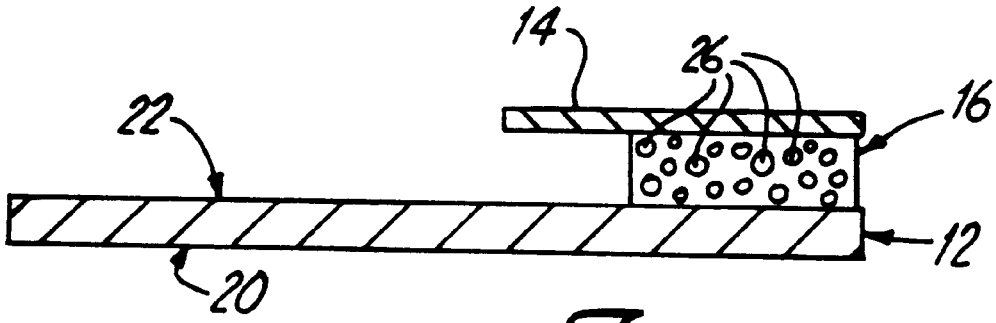
FIG. 3 is a cross sectional side view of a preferred embodiment of a uniform card of the invention prior to use.

As shown in the exaggerated and magnified cross sectional view of FIG. 3, adhesive means 16 adheres the fragrance strip 14 to the card 12. The fragrance strip 14 is preferably adhered to the card 12 in a manner similar to that disclosed in U.S. Pat. Nos. 4,988,557; 4,889,755; 4,661,388; and 4,606,956, which describe Minnesota Mining and Manufacturing Co.'s "Fragrance Burst " technology. As shown in FIG. 3, within the adhesive means 16 are located a plurality of rupturable microcapsules 26. A distinct scent is located within the microcapsules 26, which is emitted when the microcapsules 26 burst. The microcapsules 26 burst as adhesive means 16 is overcome and the fragrance strip 14 is detached from the card 12. As the microcapsules 26 rupture, a burst of fragrance of the distinct scent contained within the microcapsules 26 and associated with the particular card 12 is given off.

The card 12 is then presented to the test subject for identification of the distinct scent, or if unknown, for the identification of the presence of the distinct scent. The card 12 is discarded after it is presented to the test subject. The test subject is then presented with the remaining cards 12 of the test kit 10 for identification.

Figure 4:
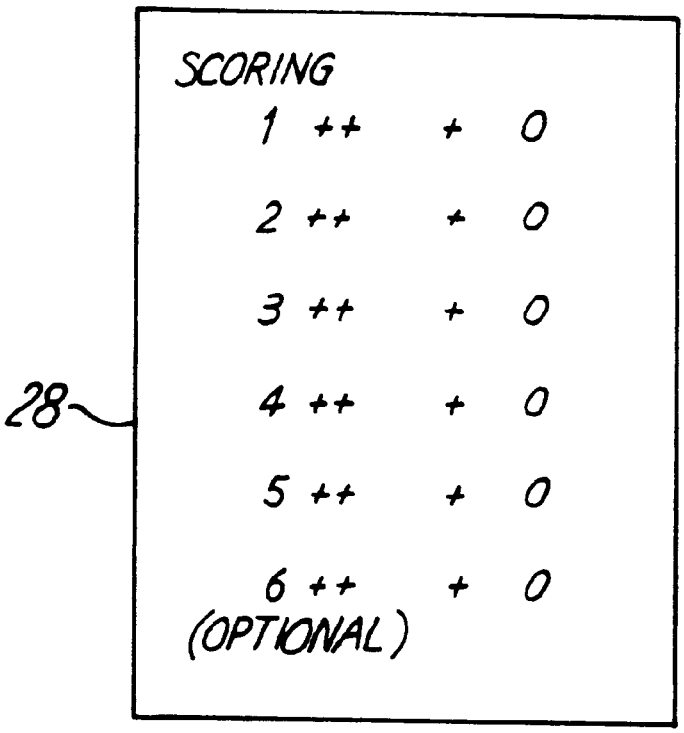
FIG. 4 is a preferred embodiment of a score card used in conjunction with the invention.

FIG. 4 illustrates a score card 28 which is preferably used in conjunction with the smell test kit 10 to record the results. In a preferred embodiment, the score card 28 is an adhesive label which can easily be placed into the test subject's medical records. In a preferred embodiment, the score card 28 records three possible results for each of the cards 12 that are presented to the test subject. The first test result being "++" is used to indicate when the test subject has identified a distinct scent associated with the presented card 12. A "+" rating indicates that the test subject identified the presence of a distinct scent, but was unable to identify what the distinct scent associated with the card 12 was. A "0" rating indicates that the test subject perceived the absence of a distinct scent with the corresponding card 12.

In a preferred embodiment, one of several distinct scents is associated with each of the different cards 12. A set of control scents are used on some of the cards 12 to identify malingering patients falsely representing either an intact or absent sense of smell. The first control scent is used as a blank portion of the test and has no distinct scent associated with its corresponding card 12. No scent should be detected by the test subject while smelling the blank card 12. The correct response should be the absence of any distinct scent and if correct would be recorded by a "0". Any other response would identify a patient falsely reporting an intact sense of smell and would evidence malingering.

A second control scent to detect malingering patients makes use of ammonia. Ammonia is detected by the trigeminal nerves and not by the olfactory nerves. Therefore, even a patient without the function of olfactory nerves should almost always still be able to detect, if not identify, the presence of ammonia. It is extremely rare that the test subject would have an absent bilateral trigeminal nerve which would prevent his or her recognition of the presence of ammonia. The anticipated correct response should be a "++" or "+". Any other response identifies a test subject that is most likely falsely reporting an absent sense of smell. The ammonia component of the test could be used only for test subjects with decreased or an absent sense of smell reported on the initial test cards 12.

In a preferred embodiment, the smell test kit 10 includes six of the cards 12. Each of the cards 12 would contain one of the following distinct scents; lemon, almond, coffee, tar, ammonia or a blank (no scent). Additionally, other distinct scents could be used as well. The key and the distinctive marks 18 are then used to identify which distinct scent is associated with which of the cards 12.

In a preferred embodiment, the smell test kit 10 is self-contained and disposable. Due to the ease with which the test 10 can be given, it can be preformed in a doctor's office, hospital room or an emergency room. Because each test kit 10 is used only once, the distinct scent associated with each of the cards 12 is uniform over time. This allows a more accurate comparison of previous smell tests which were performed using the smell test kit 10.

The smell test kit 10 can be utilized more often in medical treatment due to its low cost of manufacture, administration and uniform presentation of scent. The smell test kit 10 preferably can be administered to test subjects both before and after nose, sinus or brain surgery, to aid in evaluating the success of the surgery, and to guard against improper malpractice claims. It also can be used for testing subjects who had nasal, sinus, or head trauma, or who report a decreased or absent sense of smell. The smell test kit 10 can also be incorporated into general medical evaluations or physicals to assess the test subject's medical condition, track the subject's sense of smell over time and identify early symptoms of certain diseases, such as Alzheimer's and Parkinson's disease.

Although the present invention has been described with reference to preferred embodiments, workers skilled in the art will recognize that changes may be made in form and detail without departing from the spirit and scope of the invention. For instance, the number of distinct scents presented can be altered including the number and type of control scents. The potency of the test kits distinct scents also can be varied to more accurately test the patient's sense of smell. The potency of the distinct scents also can be identified by the key. The cards and fragrance strips can be made from various types of paper products or similar material. Also, the fragrance strips can be formed as a separate piece of material or from a portion of the card which is folded back on itself. The size and shape of the card can also be altered. The distinctive mark identifying the distinct scent associated with the cards also can be changed. Furthermore, the key identifying the distinct scent associated with the card can be incorporated with the score card which also can record the test results in a different format. By use of the self-contained, disposable smell test kit, a uniform smell test that is easy to use, self-contained and disposable is provided.

What is claimed is:

1. A medical condition diagnosing smell test kit for measuring the sense of smell of a test subject the test kit comprising:

a set of cards, wherein each card emits a different, distinct scent;

a set of fragrance strips, wherein one fragrance strip is secured to each card;

adhesive means for detachably securing the fragrance strips to the cards; and a plurality of rupturable microcapsules contained within the adhesive means that burst and emit the different, distinct scent for each card when the fragrance strip is detached from the card to assess the test subject's ability to smell.

2. The smell test kit of claim 1, and further including a score card for recording the test results.

3. The smell test kit of claim 1, wherein the test kit is self-contained and disposable.

4. The smell test kit of claim 1, wherein the distinct scents include a set of control scents.

5. The smell test kit of claim 4, wherein the set of control scents include an absence of scent and an ammonia scent.

6. The smell test kit of claim 1, wherein the set of cards are separably connected to each other.

7. The smell test kit of claim 1, wherein the set of cards are identical except that each card has a distinctive mark that is associated with one of the distinct scents, but does not identify the distinct scent to the test subject.

8. The smell test kit claim 7, and further including a key for identifying the distinct scent of the card based upon the distinctive mark on that card.

9. The smell test kit of claim 1, wherein the set of cards and the series of fragrance strips are made of paper.

10. A medical condition diagnosing smell test kit for measuring the sense of smell of a test subject, the test kit comprising:

a set of uniform cards, wherein each card emits a different, distinct scent and has a distinctive marking associated with the distinct scent that is unrecognizable to the test subject;

a set of uniform fragrance strips, wherein one fragrance strip is secured to each of the cards;

adhesive means for detachably securing the fragrance strips to the cards; and a plurality of rupturable microcapsules within the adhesive means which emit the different, distinct scent for each card when the microcapsules are ruptured as the fragrance strip is removed from the card.

11. The smell test kit of claim 10, and further including a score card for recording the test results.

12. The smell test kit of claim 10, wherein the smell test kit is self-contained and disposable.

13. The smell test kit of claim 10, wherein the distinctive marks for the set of cards correspond to a key which identifies the distinct scent for each card.

14. The smell test kit of claim 10, wherein the distinct scents emitted by the rupturable microcapsules includes a set of control scents.

15. The smell test kit of claim 14, wherein the set of control scents includes an absence of any scent and an ammonia scent.

16. The smell test kit of claim 10, wherein the cards are separably attached.

17. The smell test kit of claim 10, wherein the cards and the fragrance strips are made of paper.

18. A medical condition diagnosing smell test kit for measuring the sense of smell of a test subject, wherein the kit comprises:

a set of uniform cards, wherein each card emits a different, distinct scent when a fragrance strip secured to the card by an adhesive is removed from the card causing a plurality of rupturable microcapsules that are contained in the adhesive to burst and emit the different, distinct scent for each of the cards;

a distinctive mark unrecognizable to the test subject which identifies the different, distinct scent associated with each of the cards;

a key to identify the different distinct scent associated with the distinctive mark; and a scorecard to record the test results.

19. The smell test kit of claim 18, wherein the cards are separably connected to each other.

20. The smell test kit of claim 18, wherein the test kit is self-contained and disposable.

21. The smell test kit of claim 18, wherein the distinct scents include a set of control scents.

22. The smell test kit of claim 21, where the set of control scents include an absence of any scent and an ammonia scent.

23. The smell test kit of claim 18, wherein the cards and the fragrance strips are made from paper.

24. A medical condition diagnosing method of using a smell test kit to measure the sense of smell of a test subject, the method comprising:

identifying a different, distinct scent associated with a card, which is part of a set of uniform cards, wherein each of the cards has a distinctive mark that identifies the different distinct scent associated with the card and that is unrecognizable to the test subject;

peeling off a fragrance strip adhered to the card by adhesive, wherein a plurality of rupturable microcapsules are contained within the adhesive which burst and emit the different distinct scent associated with the card as the fragrance strip is peeled off of the card;

presenting the card with the fragrance strip peeled off to the test subject for identification of the different distinct scent being emitted by the card;

recording the results of the test subject's smell test; and repeating the procedure with each of the cards in the uniform set of cards.

25. The method of claim 24, wherein the distinct scent associated with the card is identified with a key which associates the distinctive mark to the distinct scent.

26. The method of claim 24, wherein the distinct scents include a set of control scents.

27. The method of claim 26, wherein the control scents include an absence of scent and an ammonia scent.

28. The method of claim 24, wherein the results of the smell test are recorded for each of the cards on a score card which indicates identification of the distinct scent, identification of the presence of the distinct scent, or perception of an absence of the distinct scent.

* * * * *